US005146987A

United States Patent [19]

Krieg

[11] Patent Number: 5,146,987

[45] Date of Patent: Sep. 15, 1992

[54] METHOD AND APPARATUS FOR CONTROLLING THE FLOW OF CRUDE OIL FROM THE EARTH

[75] Inventor: Ronald K. Krieg, Blaine, Wash.

[73] Assignee: RKK, Ltd., Bellevue, Wash.

[21] Appl. No.: 682,644

[22] Filed: Apr. 9, 1991

[51] Int. Cl.[5] ..... E21B 35/00; E21B 36/00; E21B 43/12

[52] U.S. Cl. ..... 166/302; 166/50; 166/57; 166/90; 169/69

[58] Field of Search ..... 166/50, 57, 97, 90, 166/95, 192, 302, 379, 387, 77, 92; 169/69

[56] References Cited

U.S. PATENT DOCUMENTS

| | | | |
|---|---|---|---|
| 2,000,381 | 5/1935 | Duffy | 166/90 |
| 2,082,216 | 6/1937 | Patton | 166/90 X |
| 3,277,964 | 10/1966 | Houpeurt et al. | 166/90 X |
| 3,738,424 | 6/1973 | Osmun et al. | 166/302 X |
| 3,885,629 | 5/1975 | Erb | 166/302 |
| 3,905,424 | 9/1975 | Elwood et al. | 169/69 X |
| 4,203,472 | 5/1980 | Dulaney | 166/57 X |
| 4,372,378 | 2/1983 | Powers | 166/57 |

*Primary Examiner*—Hoang C. Dang
*Attorney, Agent, or Firm*—Lahive & Cockfield

[57] ABSTRACT

A method and system for stopping the flow of petroleum from a location along a pipe extending from an underground petroleum deposit, when the location is at, below, or above the surface of the earth. Initially, the location is identified of at least one underground segment of the pipe between the deposit and said location along the pipe. Then, a fluid flow path is established from at least one point on the surface of the earth displaced from the identified point along the pipe to the underground region adjacent to at least one of the underground segments. A flow of a coolant is established in or along the fluid flow path and that flow is controlled whereby sufficient heat is extracted from the underground segment, in effect lowering the temperature of the flowing oil, so that the flow rate of petroleum flowing through the segment is reduced substantially to zero. The blockage may be removed by heating frozen oil in the segment so that flow of oil may be re-established in the well pipe.

5 Claims, 5 Drawing Sheets

METHOD AND APPARATUS FOR CONTROLLING THE FLOW OF CRUDE OIL FROM THE EARTH

BACKGROUND OF THE DISCLOSURE

The present invention relates to the field of crude oil engineering, and more particularly to methods and system for controlling the flow of crude oil from the ground.

There are many known techniques for removing crude oil, or crude oil, from underground deposits to the surface of the earth. Many such techniques utilize a pipe or casing that is positioned in the earth so that one end extends into the crude oil deposit and the other end is at or near the surface of the earth. The surface end is typically coupled to a pump which may draw the crude oil from the underground deposit and direct it to selected locations for Processing or for storage prior to processing. In many cases, oil deposits are moved to the surface by water head pressure.

From time to time during operations, or from external circumstances, the pipeline leading the deposit may fracture or otherwise become breached, so that uncontrolled release of crude oil occurs. In conjunction with such breach, fire may also occur, fueled by the crude oil released at the breach. In either such situation, fire or mere release of crude oil, the environmental consequences are very large, due to resultant air pollution, and saturation of the ground with crude oil. The economic effects are also substantial, for example, causing losses of millions of dollars per day per well in some instances for oil well fires.

In particular regard to oil well fires, one known method of extinguishing the fires requires the detonation of an explosive charge of nitroglycerine at or very near the fire, causing a smothering of the flame. This approach entails substantial hazards in terms of placement of the nitroglycerine at the point of the fire, which may be at a temperature as high as 4000° F. Obviously, there is great difficulty and hazard to achieving proper placement and detonation. In addition, even upon successful extinguishment of the fire, there is no certainty that the flow of crude oil from the breached pipe would be interrupted or stopped, and thus environmental damage from contamination would continue.

It is an object of the present invention to provide an improved method and system for controlling the flow of crude oil from a well.

Another object is to provide an improved method and system for stopping the uncontrolled flow of crude oil from a well.

Yet another object is to provide a new and improved method and system for extinguishing a crude oil-fueled fire at an oil wellhead.

SUMMARY OF THE INVENTION

A method and system for stopping the flow of petroleum from a location along a pipe extending from an underground petroleum deposit, when the location is at, below, or above the surface of the earth. Initially, the location is identified of at least one underground segment of the pipe between the deposit and said location along the pipe. Then, a fluid flow path is established from at least one point on the surface of the earth displaced from the identified point along the pipe to the underground region adjacent to at least one of the underground segments. A flow of a coolant is established in or along the fluid flow path and that flow is controlled whereby sufficient heat is extracted from the underground segment, in effect lowering the temperature of the flowing oil, so that the flow rate of petroleum flowing through the segment is reduced substantially to zero. The blockage may be removed by heating frozen oil in the segment so that flow of oil may be re-established in the well pipe.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
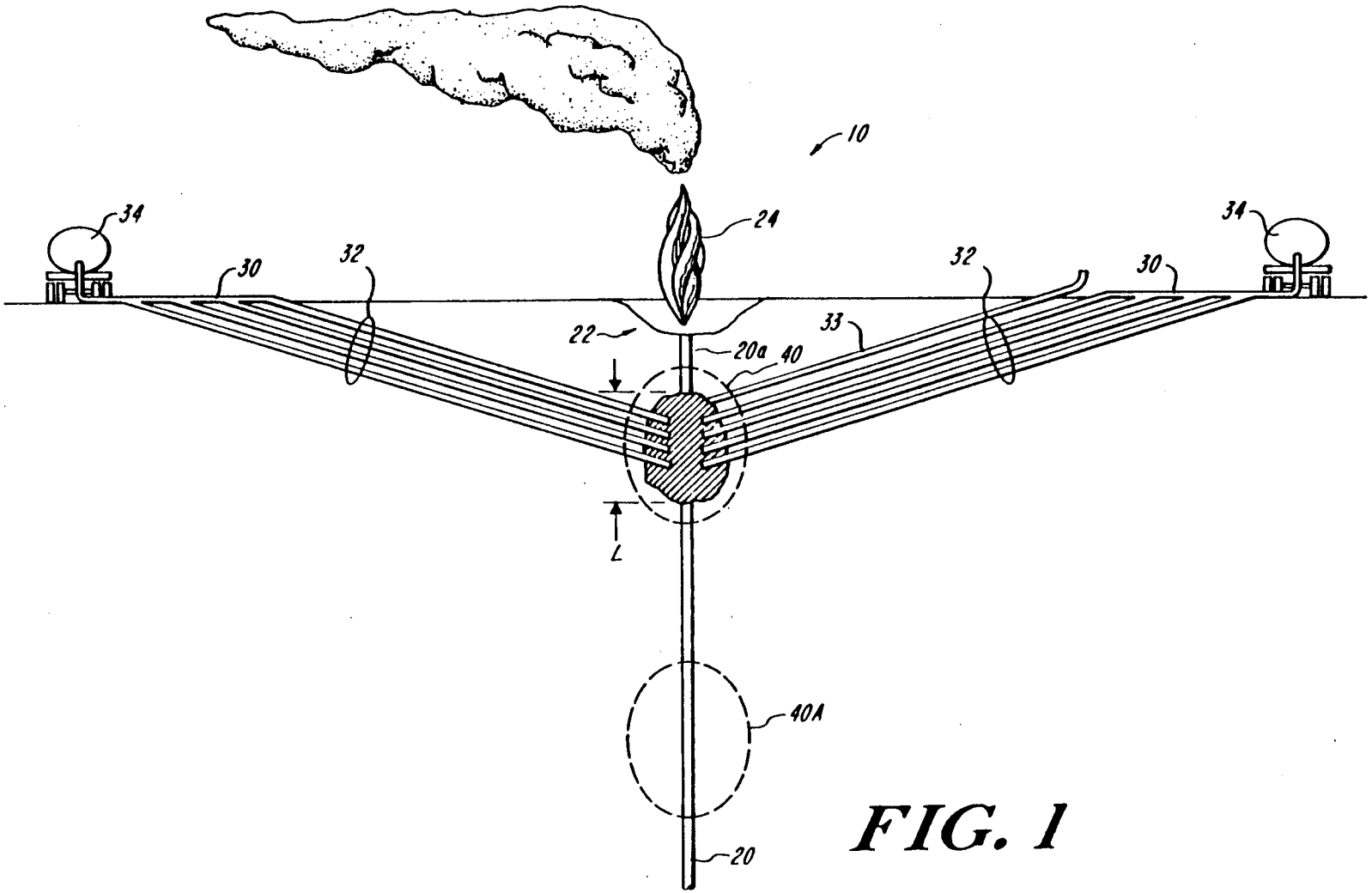
FIG. 1 shows a cut-away section of the earth bearing an oil well and an embodiment of the present invention.
Figure 2:
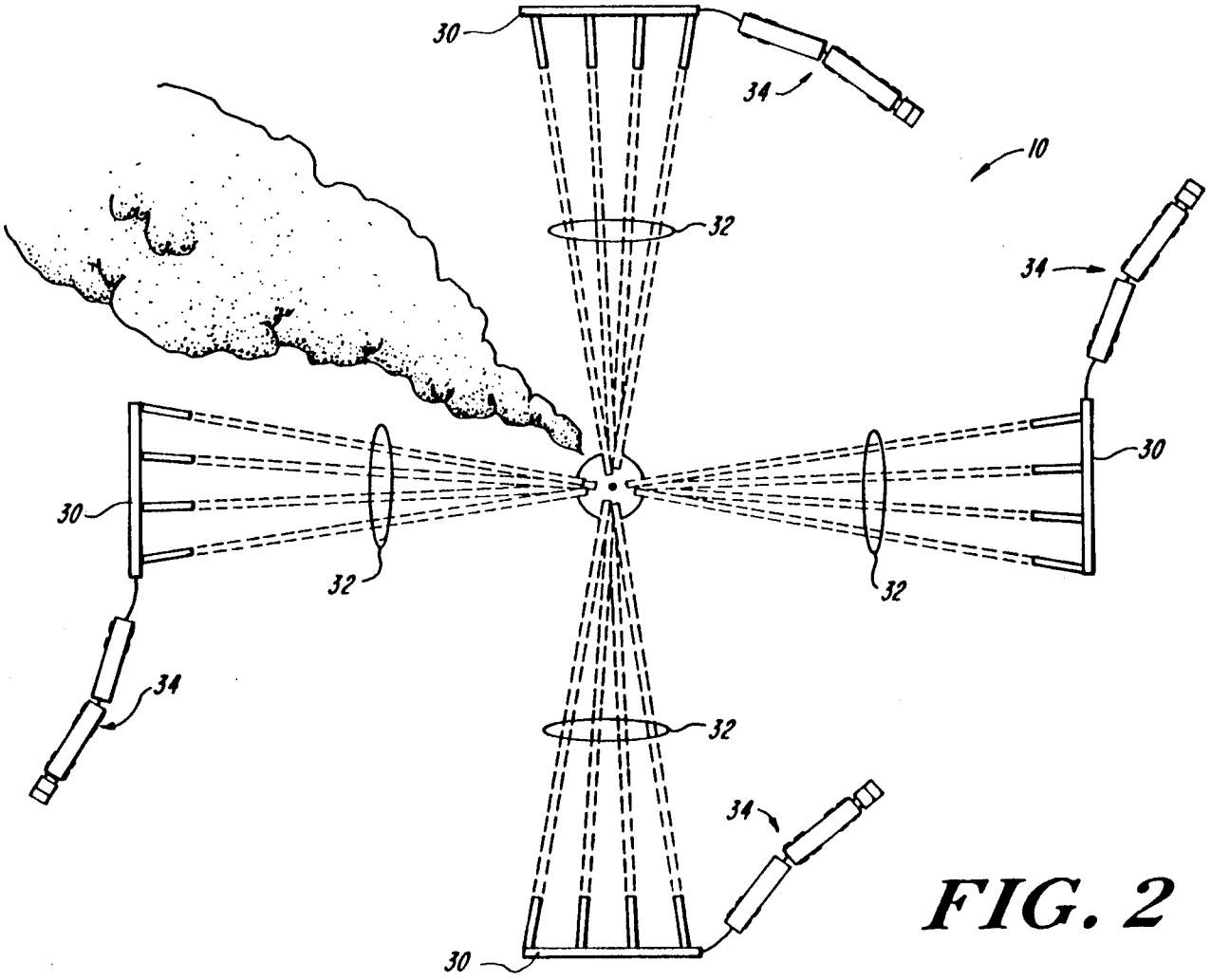
FIG. 2 shows a top view of the section of the earth and an embodiment of the invention of FIG. 1.

FIGS. 1 and 2 show an oil flow control system 10 embodying the present invention which is used to stop the oil flow, which will in turn extinguish a fire at an oil wellhead 22 slightly below the surface of the earth.

As shown in FIG. 1, the subject oil well includes a casing 20 extending from an underground crude oil deposit (not shown) to a point at the uppermost end **20*a* of the casing 20 establishing the wellhead 22. In this exemplary configuration, there is uncontrolled flow of crude oil from the end 20*a*, and further, that uncontrolled flow fuels a fire (indicated by reference designation 24) at the wellhead 22**.

In order to extinguish the flame 24 and stop the uncontrolled flow of crude oil from casing end **20*a*, the system of the invention includes a set of four manifolds 30 on the surface of the earth, radially distributed about, and laterally displaced from, the wellhead 22**. Other distributions than that illustrated can be used.

Each of the manifolds 30 is coupled to an array of cooling pipes 32 extending from the manifold 30 to points within a cooling region 40 adjacent to casing 20 between the casing end **20*a* and the underground crude oil deposit. An atmosphere vent pipe 33 extends from region 40 to the surface of the earth. Preferably, the pipes 32 are open ended to the region 40, but may be coupled in a closed loop manner permitting a circulating coolant flow path. In some forms of the invention, the pipes of array 32 may include thermal insulation as they extend from the manifold 30 until they reach the region 40**, and be uninsulated thereafter.

The manifolds 30 are each further coupled to an associated tanker truck 34 (or a suitable refrigerant system) which is adapted to pump liquid nitrogen (at temperature −195° C.) through the manifold 30 and array 32 to the region 40. In alternative embodiments, other coolants (such as Freon or ammonia or others) may be used with suitable selection of a distribution system and coolant temperature.

In operation, with the illustrated configuration, upon the detection of uncontrolled crude oil flow from the wellhead 22 (with or without the flame 24), the arrays of cooling pipes 32 are initially put in place by slant drilling (from a safe distance from the wellhead 22, i.e.

away from the flame, or contaminated region of the earth). These pipes 32 may be properly located with their distal tips positioned at desired points within a selected region 40 using conventional slant drilling techniques. Then, the manifolds 30 are coupled to the proximal ends of the pipes 32, and the manifold is in turn coupled to the tank trucks 34. The trucks 34 then pump liquid nitrogen through manifolds 30 and pipes 32 to points within region 40. The liquid nitrogen pumping continues until the region 40 about casing 20 is sufficiently cooled so that the viscosity of the crude oil within casing 20 is raised sufficiently so that substantially all flow of that crude oil through the portion of casing 20 within region 40 is stopped. Following from this stoppage of flow, the flow at the end 20*a* of casing 20 is stopped, and any fire present at that point is extinguished from lack of fuel. Following stoppage of flow and repair of the breach of casing 20, the pipes 32 may be used to heat region 40 until the viscosity within casing 20 in region 40 returns to normal, re-establishing crude oil flow in casing 20.

The length of the underground oil well casing to be exposed to liquid nitrogen (or other suitable coolant) cooling is established by computing the heat transfer coefficients of the well casing computing the heat transfer coefficients of the oil and the flowing crude oil and factoring in the temperature dependence of the crude oil flow rate. Worst case design is preferably used when computing the length of well case to be exposed to the cooling process. Generally, the flow of oil at its normal temperature through the well casing 20 is a turbulent flow. By applying the liquid nitrogen to the correct length of underground well casing, the oil flow becomes a laminar flow. After the change from turbulent to laminar flow, the flow rate decreases faster as temperature continues to drop. The computation of the length L (of casing 20 through region 40) is best performed using a series of approximations starting with flow rate of oil, temperature of oil, size of well casing pipe, wall thickness of pipe or well casing, temperature of coolant, length of well casing in contact with coolant, and heat transfer of well casing.

In various forms of the invention, particularly in said environments, the portions of region 40 immediately adjacent to casing 20 can be blown out to establish a void region around casing 20, permitting more effective heat exchange between the liquid nitrogen (or other cooling medium) and the oil within casing 20. By way of example, the void region may be established by using high pressure air angle air drills, high pressure water drills, or small explosive charges.

The above-described configuration is adapted for easily dispatched and implemented systems and methods for reversibly stopping flow of crude oil from a breach or opening in the casing extending from an underground deposit of crude oil. The systems and methods may be effected in a fast, efficient and safe manner. Following stoppage of flow, a control valve and associated piping may be installed at the breach. While the coolant is liquid nitrogen dispatched from mobile tank trucks in this exemplary configuration, other coolants and dispensing means may be used. Further, the above-described embodiment includes a single cooling region 40, but in other embodiments may include one or more additional such regions (exemplified by the region 40A shown in FIG. 1) where such additional regions are cooled in a manner similar to region 40 by a set of manifolds (not shown) and cooling pipe arrays (not shown) similar to manifolds 30 and arrays 32.

Figure 3:
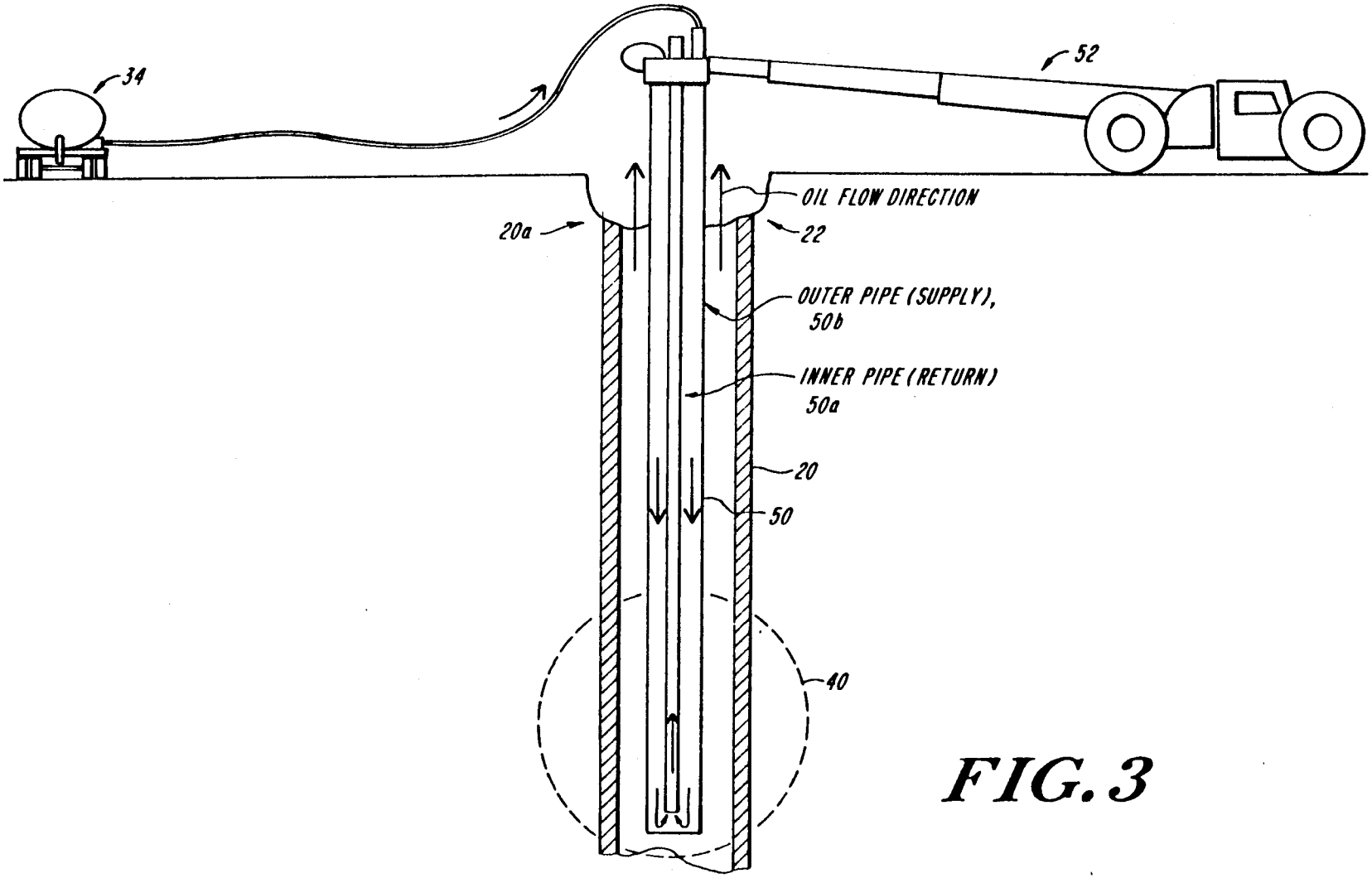
FIGS. 3–5 show cut-away sections of the earth bearing an oil well and an alternative embodiments of the invention.
Figure 4:
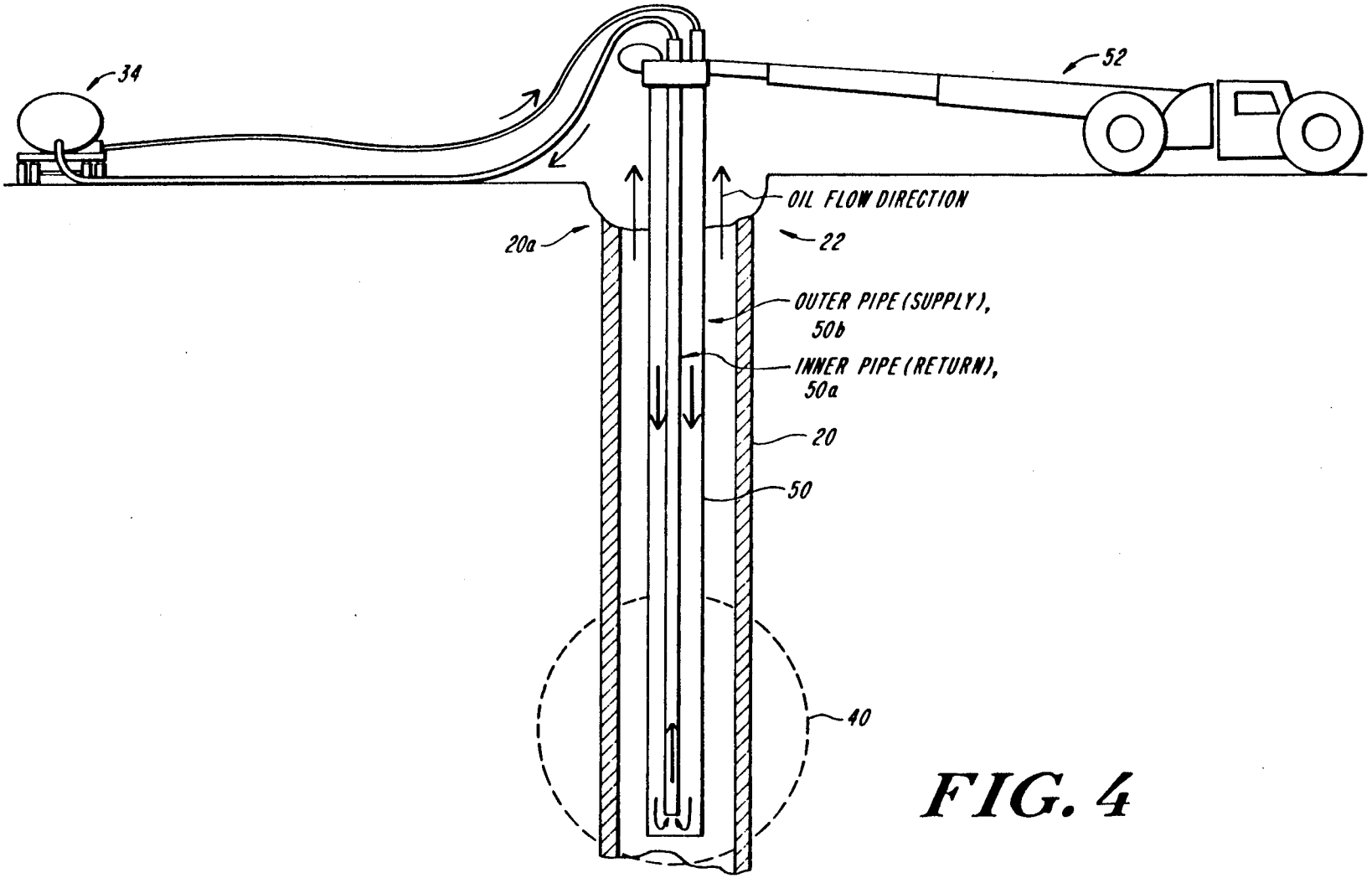

An alternate configuration is shown in FIG. 3, where elements corresponding to elements in FIGS. 1 and 2 are identified with the same reference designations. In FIG. 3 a concentric, coaxial closed end pipe 50 is inserted into the flowing crude oil in casing 20 using a crane 52. The concentric pipe arrangement permits flow of coolant (e.g. liquid nitrogen or other coolant) down the outer pipe and up the inner pipe (or the opposite flow direction, if desired) and vented to the atmosphere. The tip of the coaxial pipe 50 is positioned at a point between the breach in casing 20 and the crude oil deposit. The coolant is pumped into the pipe 50 from the tank truck (or refrigeration system) 34 to establish cooling in region 40, thereby increasing the viscosity of the flowing crude oil until there is substantially a stoppage in flow. For non-fire situations, the concentric pipe may be directly pushed into place within casing 20. As shown in FIG. 4, the concentric pipe system of FIG. 3 may be configured with a circulating coolant flow path, with the coolant being re-cooled following exit from the casing. The latter configuration is particularly useful where Freon is used, but may be used with other coolants as well.

Figure 5:
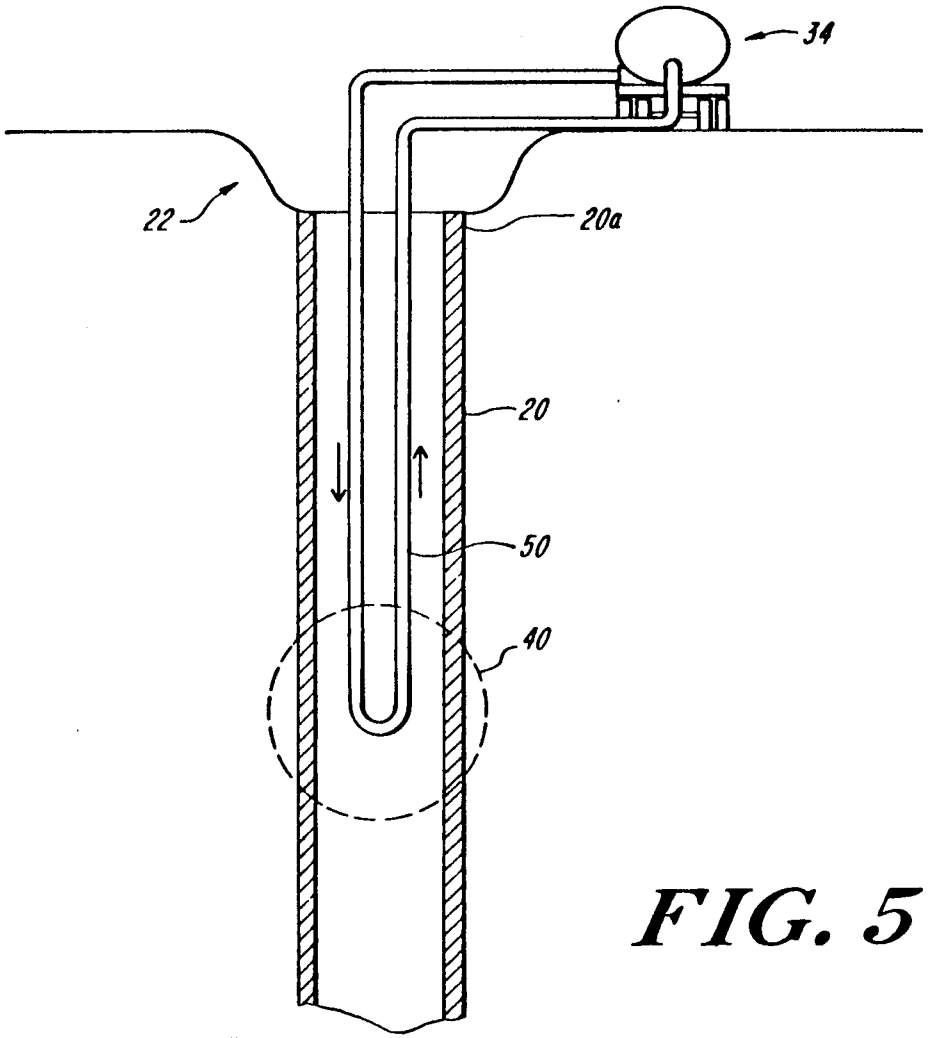

Rather than the concentric pipe configuration of FIGS. 3 and 4, a U-shaped pipe can be used to establish the coolant flow path, as shown in FIG. 5. In all of these cases, the pipes may include thermal insulation, except at the region to-be-cooled, to enhance the cooling. In FIGS. 3–5, similar elements are identified with the same reference designations.

In other embodiments, a single pipe may be positioned within the casing 20 and liquid nitrogen injected under pressure directly into the flowing crude oil. For fire situations, the pipe may be inserted into casing 20 using a right-angle extrusion device positioned over the end 20*a* of casing 20 for establishing a 90 degree bend. Using this technique requires a heat resistant extrusion/-bending device and pipe, since the fire is near (but typically on the order of approximately ten feet from) the end 20*a* of casing 20.

In yet other embodiments, the pipe arrays 32 may extend directly to the crude oil deposit near the entry point to casing 20. Liquid nitrogen (or other coolants) may be injected through the pipes to freeze the crude oil at that entry point, thereby blocking flow therethrough.

As with all of the above-described embodiments, the flow stopping blockages may readily be removed by heating the cooled region.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Method for substantially stopping the flow of crude oil from a location along a pipe extending from an underground crude oil deposit, comprising the steps of:

A. identifying the location of one or more underground segments of said pipe between said deposit and said location along said pipe, B. establishing a fluid flow path from at least two points on the surface of the earth displaced from said location along said pipe to an underground region adjacent to at least one of said one or more underground segments, and C. establishing flow of a coolant in said fluid flow path and controlling said flow whereby sufficient heat is extracted from said one underground segment so that the flow rate of crude oil flowing through said one segment is reduced substantially to zero, wherein said flow path establishing step includes the substeps of:

i. slant drilling boreholes from at least two of said points to said underground region, and ii. placing an elongated hollow tube within each of said boreholes, whereby said flow path is defined at least in part by the inner walls of said tubes, wherein said slant drilling step includes the step of establishing boreholes from at least two points radially dispersed by 180 degrees about the axis of said pipe.

2. The method of claim 1 wherein said flow establishing step includes the step of using liquid nitrogen as said cooling.

3. The method of claim 1 wherein said flow path establishing step includes the substep of:

placing an elongated hollow tube within said pipe, whereby one end of said tube extends from near or at the surface of the earth and the other end extends into said region, whereby said flow path is defined at least in part by the inner walls of said tube.

4. System for substantially stopping the flow of crude oil from a location along a pipe extending from an underground crude oil deposit, comprising:

A. means for identifying the location of at least one underground segment of said pipe between said deposit and said location along said pipe, B. means for establishing a fluid flow path from at least two points on the surface of the earth displaced from said location along said pipe to an underground region adjacent to at least one of said one or more underground segments, and C. means for establishing flow of a coolant in said fluid flow path and controlling said flow whereby sufficient heat is extracted from said one underground segment so that the flow rate of crude oil flowing through said one segment is reduced substantially to zero, wherein said flow path establishing means includes:

a plurality of elongated hollow tubes positioned in a corresponding plurality of slant-drilled boreholes extending from at least two of said points to said underground region, whereby said flow path is defined at least in part by the inner walls of said tubes, wherein said elongated tubes are positioned in slant-drilled boreholes from at least two points radially dispersed by 180 degrees about the axis of said pipe.

5. The system of claim 4 wherein said flow establishing means further includes means for establishing a flow of liquid nitrogen as said coolant.

* * * * *